US011452352B2

(12) United States Patent
Fereyre

(10) Patent No.: US 11,452,352 B2
(45) Date of Patent: Sep. 27, 2022

(54) HAIRSTYLING APPARATUS USING STEAM VIA THE TREATMENT SURFACE AND WITH A COMB

(71) Applicant: SEB S.A., Ecully (FR)

(72) Inventor: Régis Fereyre, Chavanay (FR)

(73) Assignee: SEB S.A., Ecully (FR)

( * ) Notice: Subject to any disclaimer, the term of this patent is extended or adjusted under 35 U.S.C. 154(b) by 524 days.

(21) Appl. No.: 15/311,091

(22) PCT Filed: May 12, 2015

(86) PCT No.: PCT/FR2015/051238

§ 371 (c)(1),
(2) Date: Nov. 14, 2016

(87) PCT Pub. No.: WO2015/173507

PCT Pub. Date: Nov. 19, 2015

(65) Prior Publication Data

US 2017/0112254 A1 Apr. 27, 2017

(30) Foreign Application Priority Data

May 14, 2014 (FR) ..... 1454271

(51) Int. Cl.

| | |
|---|---|
| ***A45D 1/04*** | (2006.01) |
| ***A45D 19/16*** | (2006.01) |
| ***A45D 1/06*** | (2006.01) |
| ***A45D 2/00*** | (2006.01) |
| ***A45D 1/00*** | (2006.01) |
| ***A45D 1/08*** | (2006.01) |
| ***A45D 1/28*** | (2006.01) |

(52) U.S. Cl.

CPC ..... *A45D 19/16* (2013.01); *A45D 1/00* (2013.01); *A45D 1/04* (2013.01); *A45D 1/06* (2013.01); *A45D 1/08* (2013.01); *A45D 1/28* (2013.01); *A45D 2/001* (2013.01); *A45D 2/002* (2013.01); *A45D 2001/008* (2013.01)

(58) Field of Classification Search

CPC ..... A45D 19/16; A45D 2001/008; A45D 1/06
USPC ..... 132/228, 227, 272
See application file for complete search history.

(56) References Cited

U.S. PATENT DOCUMENTS 2,880,299 A 3/1959 Jones
6,070,596 A * 6/2000 Altamore ..... A45D 1/04 132/224

(Continued)

FOREIGN PATENT DOCUMENTS

EP 1396207 A1 3/2004
EP 1516554 A1 3/2005

(Continued)

*Primary Examiner* — Tatiana L Nobrega
(74) *Attorney, Agent, or Firm* — The Webb Law Firm

(57) ABSTRACT

Provided is a hairstyling apparatus (1) including a portable treatment unit (2) provided with two arms (3, 4) arranged to form a clamp provided with two treatment surfaces (5, 6) disposed opposite one another and enabling a lock of hair to be clamped therebetween, the portable treatment unit including steam-diffusion means (7) arranged to diffuse steam from a first (5) of the two surfaces towards the second (6) of the two surfaces, one of the arms (3, 4) including a comb (19) disposed downstream or upstream of one of the surfaces (5, 6) of the arm (3, 4).

21 Claims, 9 Drawing Sheets

(56) References Cited

U.S. PATENT DOCUMENTS

| | | | | |
|---|---|---|---|---|
| 6,941,955 | B2 * | 9/2005 | Yao | A45D 1/04 132/225 |
| 8,757,175 | B1 * | 6/2014 | Leung | A45D 2/001 132/228 |
| 2004/0000319 | A1 * | 1/2004 | Carballada | A45D 1/04 132/224 |
| 2006/0108344 | A1 * | 5/2006 | Kim | A45D 1/04 219/225 |
| 2008/0060665 | A1 * | 3/2008 | Umeno | A45D 19/02 132/112 |
| 2008/0283081 | A1 * | 11/2008 | Habibi | A45D 1/04 132/224 |
| 2012/0111356 | A1 * | 5/2012 | Vacheron | A45D 1/04 132/228 |
| 2015/0289622 | A1 * | 10/2015 | Fereyre | A45D 1/04 132/211 |

FOREIGN PATENT DOCUMENTS

| | | | | | |
|---|---|---|---|---|---|
| EP | 1515628 | B1 | | 6/2007 | |
| EP | 1515629 | B1 | | 12/2007 | |
| FR | 2967017 | A1 | | 5/2012 | |
| JP | 2000157322 | A | | 6/2000 | |
| JP | 2014151139 | A | | 8/2014 | |
| KR | 100546084 | | | 1/2006 | |
| KR | 1020130068309 | | * | 6/2013 | A45D 1/04 |
| WO | 2014064660 | A1 | | 5/2014 | |
| WO | WO2014064660 | | * | 5/2014 | A45D 1/04 |
| WO | WO2014096691 | | * | 6/2014 | A45D 1/04 |

* cited by examiner

HAIRSTYLING APPARATUS USING STEAM VIA THE TREATMENT SURFACE AND WITH A COMB

CROSS-REFERENCE TO RELATED APPLICATIONS

This application is the United States national phase of International Application No. PCT/FR2015/051238 filed May 12, 2015, and claims priority to French Patent Application No. 1454271 filed May 14, 2014, the disclosures of which are hereby incorporated in their entirety by reference.

FIELD OF THE INVENTION

The invention concerns a hairstyling apparatus using steam that comprises a handheld steam treatment unit intended to treat hair with steam in order to style it. In addition to steaming hair, the handheld treatment unit of this hairstyling apparatus is generally configured to heat hair in order to style it. For example, such a hairstyling apparatus, depending on its configuration, can be used to straighten, curl, or crimp hair.

Description of Related Art

Various hairstyling apparatuses are known that can be used to treat hair in order to straighten, curl, or crimp it. These hairstyling apparatuses comprise a handheld treatment unit consisting primarily of two arms, or jaws, each with a surface that can be flat or curved. The two arms have a joint between them so as to form a clamp configured to grip hair between the two surfaces that face each other, when the two arms come together. These two arms also include an area to which gripping pressure is applied in order to open and close the clamp and manipulate it during styling. At least one of these two surfaces has a heating device so that hair can be heated while clamped. A lock of hair is straightened by clamping the lock between the two surfaces and moving the closed clamp along the lock, from the root toward the end. A lock of hair is curled by clamping the lock between the two surfaces and rolling the lock at least partially around the surfaces, with heat making the hair hold the curl.

To improve hairstyling, it is known to use steam treatment in addition to the heat treatment, with the steam projected or diffused onto the hair. Several examples of embodiments of such hairstyling apparatuses are described in documents JP2000157322A, EP1396207A1, EP1515628B1, EP1515629B1, EP1516554B1, FR2967017A1. According to these various embodiments, in addition to the known and aforementioned characteristics of a hairstyling apparatus, the handheld treatment unit includes a means of projecting steam configured to project the steam from the first of the two surfaces to the second of the two surfaces. In documents EP1396207A1 and EP1516554B1, the handheld treatment unit includes a means of aspirating the steam, located on said second surface, to evacuate the steam projected from the first surface after it passes through the lock of hair. In documents EP1515628B1 and EP1515629B1, in one possible embodiment, the means of projecting steam are configured to project the steam from the two surfaces that face each other during clamping. In document FR2967017A1, a patent application filed by the applicant, the optimized design of the steam generation means allows for a steam flow rate on the order of 3-4 g/min., higher than other hairstyling apparatus designs that offer a steam flow rate of less than 2 g/min., which makes it possible to supply steam evenly to the entire length of the clamped lock of hair during steam treatment and allows that lock of hair to be rapidly steam treated as the handheld treatment unit is moved along the lock of hair.

In addition, document KR100546084 describes a handheld hair-straightening apparatus whose lower arm has a heating plate, a single row of holes for the passage of steam, a double-comb bar with two rows of teeth, one on each side of the same heating plate to ensure that the lock of hair is combed upstream and downstream of the straightening zone when in closed position.

Also, document JP2014151139 describes a handheld hair-straightening apparatus on which each of the two arms has a heating plate, two rows of holes for the passage of steam onto a heating plate, wherein each arm has a single comb adjacent to the plate and supported by the arm and the combs are located on either side of the apparatus, to ensure that the lock of hair is combed upstream and downstream of the straightening zone when in closed position.

This invention is intended to provide a hairstyling apparatus with performance comparable to that of the hairstyling apparatus described in document FR2967017A1 while reducing its size, for example reducing the length of the hairstyling apparatus and/or the height, for example.

This invention is intended to provide a hairstyling apparatus with performance comparable to that of the hairstyling apparatus described in document FR2967017A1, but using a lower steam flow rate.

This invention is intended to provide a hairstyling apparatus with performance comparable to that of the hairstyling apparatus described in document FR2967017A1 while simplifying its design.

This invention is intended to provide a hairstyling apparatus with performance comparable to that of the hairstyling apparatus described in document FR2967017A1 while decreasing its manufacturing cost.

This invention is intended to provide a hairstyling apparatus with performance comparable to that of the hairstyling apparatus described in document FR2967017A1 while reducing the volume of liquid used for steam generation.

SUMMARY OF THE INVENTION

Accordingly, the invention concerns a hairstyling apparatus comprising a handheld treatment unit having two arms configured to form a clamp with two surfaces that face each other, together allowing a lock of hair to be clamped. The handheld treatment unit includes a means of diffusing steam configured to diffuse steam from the first of the two surfaces toward the second of the two surfaces. It is noteworthy that one of the arms has a comb located downstream or upstream of one of the surfaces of said arm. This makes it possible to untangle and aerate the lock of hair separately from its steam treatment, thereby promoting the passage of steam through the hair. Combining a straightener with treatment surfaces through which steam is diffused or projected and a comb adjacent to the treatment zone created by clamping the two treatment surfaces against each other allows the invented apparatus to provide, in a single usage action, a combination of results desired by stylists: natural straightening accompanied by gentle treatment of the hair, in particular by hydrating and softening it. Natural straightening is understood to mean not "stick" straightening, in which the hair is made severely straight, but straightening that leaves the hair in a smooth fall that does not look pressed. The comb is located so as to protrude from the arm of the apparatus to the treatment surface, for example the teeth of the comb protrude with respect to the treatment surface orthogonally in relation to the plane defined by the treatment surface. The comb's angle of inclination relative to the treatment surface is about 90°, but can range from 45 to 135° relative to the plane defined by the treatment surface.

According to the invented hairstyling apparatus, the comb is a single comb on the apparatus and is located either upstream or downstream of one of the surfaces. Having a single comb along the entire apparatus makes it possible during treatment to choose whether combing is done upstream or downstream of straightening.

If the comb is used upstream of straightening—i.e., the comb is used on the side toward the free end of the lock of hair—it can spread the lock of hair so as to promote good heat transferal from the plates to the lock of hair and generate tension that improves straightening performance.

If the comb is used downstream of straightening—i.e., the comb is used on the side toward the roots of the lock of hair—it gives a final look that is less flattened and more natural.

This allows the user to choose, when using the apparatus on different locks of hair, the type of treatment desired, which is not possible with two combs located laterally on a straightening plate as with straighteners according to the prior art.

In a first alternative concerning the location of the comb relative to the treatment surface in the invented hairstyling apparatus, the comb is spaced at a distance from the adjacent treatment surface such that it is not in contact with said treatment surface. This allows the thermal action to be separate from the combing action. Because of this, any type of material can be used for the comb that would resist the high temperature of the straightening plates, around 230° C. The comb can be spaced at least 1 mm away from the adjacent treatment surface, preferably 2 mm.

In a second alternative concerning the location of the comb relative to the treatment surface, the comb can be against the adjacent treatment surface such that it is in contact with said treatment surface. This allows for a compact apparatus with better heating of the hair, which eliminates a piece and therefore reduces the length of the production process.

According to the invented hairstyling apparatus, the comb defines a series of teeth extending from a base; the base of the teeth is located in the plane (P) of the treatment surface adjacent to the comb. In other words, the hollow for the tooth is located essentially at the same level as the treatment zone created by clamping the two treatment surfaces together.

According to the invented hairstyling apparatus, each of the arms has a distal portion, and the comb is mounted directly on the distal portion of the arm that holds the comb. This distal part of the device has the shape of an external shell that holds the comb. This makes the apparatus more compact and reduces its manufacturing cost.

According to this characteristic, the comb can be located so as to project from the width of the distal part, from the external shell of the apparatus, for example.

According to this same characteristic, at least the free ends of the comb's teeth can be brought to face the width of the distal part of the arm that is not holding the comb (or of the external shell of the apparatus comprising said arm) when the apparatus is in closed position. This reduces the encumbering effect of the comb function on the apparatus. In closed position, the comb may not come into contact, so as not to pull on the hair between and over the teeth of the comb.

According to the invented hairstyling apparatus, the comb is made of at least one of the following materials: thermosetting plastic, metal or aluminum alloy, thermoplastic.

According to the invented hairstyling apparatus, the comb has teeth with a pyramidal, conical, or cylindrical (round or elliptical) shape or a triangular section, or a combination of at least two of these shapes.

According to the invented hairstyling apparatus, the comb has teeth with a regular gap (e) of 1-8 mm between them, preferably 1-3 mm. The preferred value is 1 mm.

According to the invented hairstyling apparatus, the teeth have a height (h) of 3-25 mm, preferably 5-15 mm.

According to the invented hairstyling apparatus, the comb is permanently attached to the apparatus.

According to the invented hairstyling apparatus and as an alternative to the preceding characteristic, the comb is attached to the apparatus in a detachable fashion, and can even be interchanged with a different secondary comb. The different comb can be a comb with teeth having a different shape and/or height and/or spacing and/or thickness.

According to the invented hairstyling apparatus, a means of confining the diffused steam is provided between the two surfaces clamped against each other. This means of confinement makes it possible to keep a quantity of steam in contact with the lock of hair, with even distribution, in a confinement space located between the two surfaces that are clamping the lock of hair, to provide optimal steam treatment. This steam remains in the confinement space for a length of time before escaping under the steam flow action. This steam confinement allows the advantage of reducing the steam flow from the means of steam generation in the handheld treatment unit. The steam is provided and circulated by diffusion or projection means, and circulates with or without excessive pressure.

According to the invented hairstyling apparatus, the means of steam confinement comprises a groove located in the second of the two surfaces, facing the means of diffusion. The steam passes through the lock of hair and remains confined in that groove.

According to this embodiment of the invented hairstyling apparatus, the groove opens onto at least one of the two longitudinal edges of the second surface, so as to allow this steam to escape under the action of the steam flow exiting the means of diffusion, after having kept that steam confined in said groove. The steam in the confinement space is thereby renewed. This makes it possible to maintain a level of steam pressure in the confinement space that can be essentially constant.

According to this embodiment of the invented hairstyling apparatus, the groove is 2-10 mm wide, preferably 2-6 mm and even more preferably 2.5 mm, and is 0.5-5 mm deep, preferably 0.5-2 mm and even more preferably 1 mm. These dimensions allow the confinement space to be optimized so as to maintain a sufficient amount of renewed steam in contact across the width of a lock of hair in order to style it. In addition, the groove is 20-220 mm long, preferably 90 mm, so as to optimize the volume of the confinement space for a lower steam flow rate.

According to the invented hairstyling apparatus, the first surface contains a furrow with a bottom surface, wherein the means of steam diffusion is placed so as to diffuse the steam from that bottom surface, and the means of steam confinement comprises the furrow, in addition to or even in substitution of the aforementioned groove located in the second of the two surfaces.

According to the invented hairstyling apparatus, the furrow forms a concave space in the treatment surface with a volume of 500-2500 $mm^3$.

According to the invented hairstyling apparatus, the furrow is 3-8 mm wide, preferably 4-7 mm, and is 1-4 mm deep, preferably 1.5-3 mm.

According to the invented hairstyling apparatus, the furrow is 20-220 mm long, preferably 90 mm.

When the invented hairstyling apparatus includes both a groove and a furrow as described above, the groove is located facing the furrow. In addition, the groove and the furrow preferably have essentially identical volumes.

In one variation of the invented hairstyling apparatus, having a groove as described above, the first surface has two adjoining furrows, each with a bottom surface, and the means of diffusion are placed so as to diffuse the steam from at least one of those two bottom surfaces. In addition, the groove is placed so as to face the two furrows.

According to the invented hairstyling apparatus, the at least one furrow opens onto at least one of the two longitudinal edges of the first surface, which allows steam to escape after having been diffused and held in the confinement space.

In one embodiment of the invented hairstyling apparatus, the means of steam diffusion includes multiple diffusion orifices located along the bottom surface of at least one furrow. In one variation, this means of steam diffusion includes a diffusion slot located on the bottom surface of at least one furrow.

According to one embodiment of the invented hairstyling apparatus, there is a grid above the at least one furrow on the first surface. This contributes to better distribution of the steam onto the lock of hair.

According to another embodiment of the invented hairstyling apparatus, it has a single furrow with a curved shape. In addition, the groove has a rounded grid whose form matches said curved furrow. This contributes to better distribution of the steam onto the lock of hair while keeping it under tension as the handheld treatment unit holding the lock of hair is moved.

According to another embodiment of the invented hairstyling apparatus, it has a furrow and a groove that are circular in shape, so as to form a cylinder when the clamp is in closed position. In addition, the hairstyling apparatus includes a perforated roller mounted so as to rotate inside of that cylinder. This allows steam to be distributed into the confinement space constituted by said cylinder, with the rotation of the roller preventing the lock of hair from being pulled as the handheld treatment unit is moved along the lock of hair.

In a first alternative for locating the means of confinement on the surfaces of the invented hairstyling apparatus, the means of steam confinement are off-center on the surfaces. It must be understood that the means of confinement are not in the middle of the surfaces but rather upstream or downstream on the surfaces. More precisely, the means of confinement can be in the form of a confinement system that is off-center on the treatment surface, for example a single assembly formed at least by the groove that is off-center on the treatment surface or straightening plate with respect to its median plane and crosses it orthogonally.

According to the invented hairstyling apparatus, each of the two surfaces has a heating plate, and those heating plates are located facing each other and together can clamp a lock of hair. This allows heat treatment of the lock of hair at the same time as steam treatment.

Preferably, according to this embodiment of the hairstyling apparatus with two heating plates, the means of steam confinement are located between the two heating plates. This offers the advantage of heating the steam that is present in the confinement space.

According to the invented hairstyling apparatus, the means of steam confinement can be off-center on the surfaces.

According to this preferred embodiment of the invented hairstyling apparatus, the means of steam confinement are off-center on the downstream parts of the heating plates, which allows the lock of hair to be steam-treated before it is heat-treated, as the handheld treatment unit is moved along the lock of hair. Preferably, the median of the confinement means is located at a distance dl from the downstream edge of the heating plates, and the ratio of the distance d1 to the width l1 of the heating plates is 0.1-0.4.

In a second alternative for locating the means of confinement on the surfaces, the means of steam confinement are essentially centered on the surfaces. In other words, the median of the confinement means is located at a distance dl from the downstream edge of the heating plates, and the ratio of the distance d1 to the width l1 of the heating plates is 0.4-0.6, preferably equal to about 0.5. This placement allows the comb to be used upstream or downstream without having to modify the straightening and steaming treatment sequence. This placement also makes it possible to provide a less-expensive apparatus.

According to the invented hairstyling apparatus, it includes a steam shut-off that is configured to block the steam escaping from the means of confinement in the direction of the proximal part of the clamp, with said proximal part configured for manipulating the handheld treatment unit. This protects the hand that is manipulating the handheld treatment unit against steam burns.

According to the invented hairstyling apparatus, the means of steam diffusion are configured so as to deliver a steam flow rate of 0.5-2 g/min., preferably 0.9-1.2 g/min. This allows the use of traditional or innovative means of steam generation on the handheld treatment unit, with a limited size and a simplified design compared to those described in document FR2967017A1.

Still according to the invented hairstyling apparatus, the means of steam diffusion can also be configured so as to deliver a steam flow rate of 0.05-0.5 g/min., preferably 0.1-0.3 g/min. and in particular equal to 0.1 g/min. These two steam flow ranges are equally effective, and the choice depends on the various steam generation technologies used.

According to the invented hairstyling apparatus, the means of steam generation includes a steam generation chamber with a heating device and a temperature measurement device. The temperature measurement device allows the temperature of the surfaces to be controlled.

According to the invented hairstyling apparatus, the means of steam generation includes a reservoir of liquid to be converted to steam and, in the fluid connection to the steam generation chamber, a pump designed to activate when the two surfaces are clamped together, to move the liquid from the reservoir to the steam generation chamber. It can be a water pump capable of working with steam flow rates in the aforementioned range of about 0.5-2 g/min.

Alternatively, according to the invented hairstyling apparatus, the means of steam generation includes a reservoir of liquid to be converted to steam and, in the fluid connection to the steam generation chamber, an air pump designed to activate when the two surfaces are clamped together, to move the liquid from the reservoir to the steam generation chamber. Such an air pump works with steam flow rates in the aforementioned range of about 0.05-0.5 g/min.

Alternatively, according to the invented apparatus, the means of steam generation includes a liquid reservoir with a fluid connection to a piece of felt intended to come into contact with the heating device.

According to the invented hairstyling apparatus, the means of diffusing steam define a confinement space constituted only by the volume of the groove in the second surface.

According to the invented hairstyling apparatus, the means of diffusing steam alternatively define a confinement space constituted only by the volume of the furrow including the steam diffusion orifices on the first surface.

According to the invented hairstyling apparatus, the treatment surfaces have a length (L1) of 80-120 mm and a width (l1) of 20-35 mm.

BRIEF DESCRIPTION OF THE DRAWINGS

The following description of various embodiments shows the characteristics and advantages of the invented hairstyling apparatus. This description is based on figures, which include:

FIG. 2' illustrates two heating plates located on the two arms of the handheld treatment unit, respectively in the clamped and open positions of the clamp, in an alternative mode to that illustrated in FIG. 2;

DETAILED DESCRIPTION OF THE INVENTION --

In the following description, the same references are used to designate identical or similar characteristics according to the various embodiments of the invented hairstyling apparatus that are described with reference to FIGS. 1-21.

Figure 1:
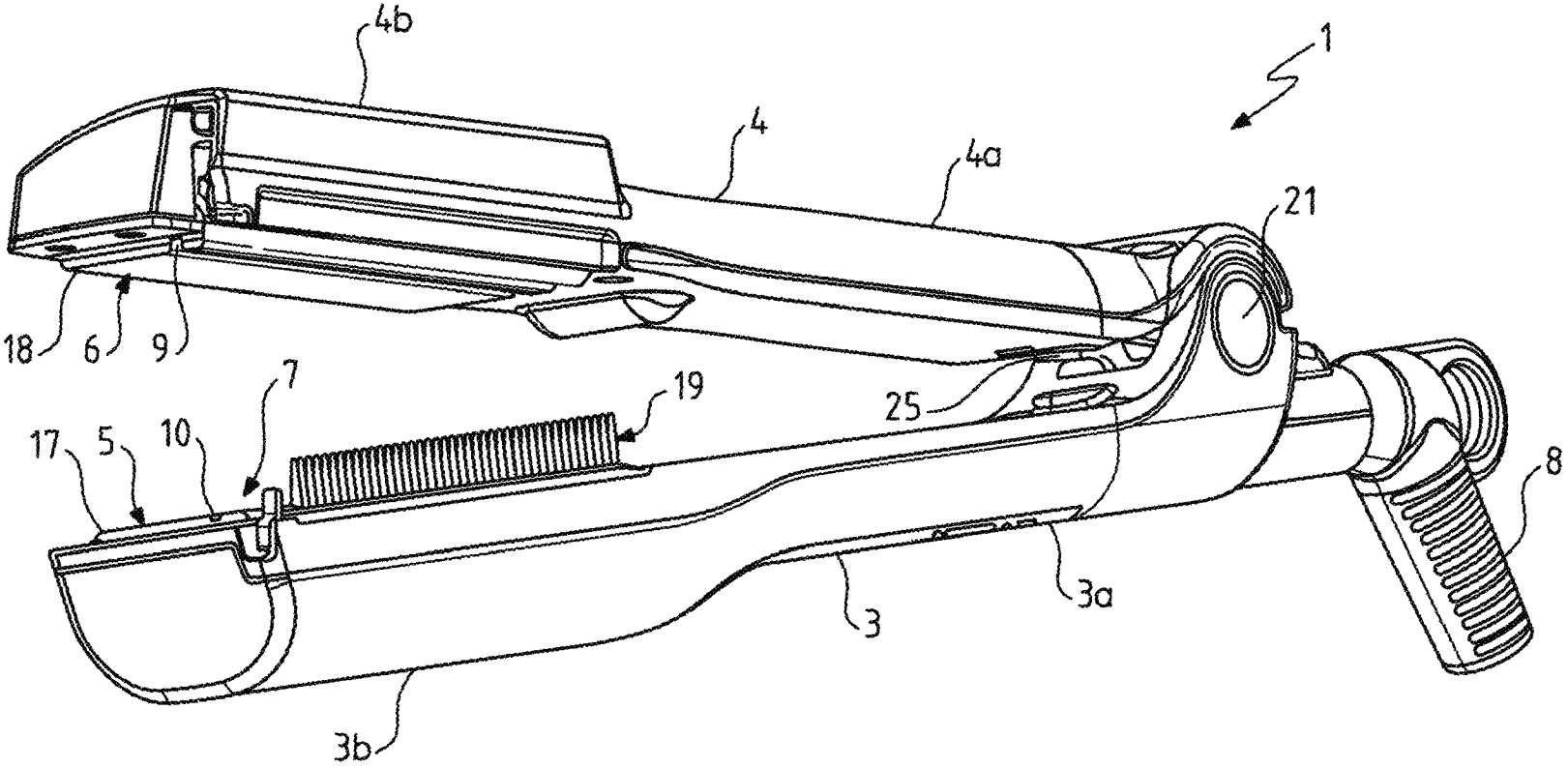
FIG. 1 illustrates an invented hairstyling apparatus, of the steam straightener type.

In FIG. 1, the invented hairstyling apparatus 1 is a hair straightener. It comprises a handheld treatment unit 2. This handheld treatment unit 2 is powered electrically by means of an electrical cord 8. The handheld treatment unit 2 comprises two arms 3, 4—also called jaws—joined to each other by means of a pivot connection 21 that enables them to clamp. The housings of the arms are defined by outer shells, for example.

Each of the two arms 3, 4 has a proximal part 3*a*, 4*a*. These two proximal parts 3*a*, 4*a* can be gripped simultaneously with one hand, permitting manipulation of the handheld treatment unit 2 and closing of the clamp when the two proximal parts 3*a*, 4*a* are squeezed together.

The two arms 3, 4 each have a surface 5, 6 on the internal face of their distal part 3*b*, 4*b* that together allow the lock of hair to be clamped. According to the embodiment in FIG. 1, the surfaces 5, 6 are flat, forming two heating plates 17, 18. When the clamp is closed, the heating plates 17, 18, which face each other, come into contact with each other, resulting in the clamping action.

In one embodiment, the handheld treatment unit 2 of the hairstyling apparatus 1 according to the invention will be able to duplicate technical characteristics similar to those described in patent application FR2967017A1 filed by the applicant, regarding implementation of the means of heating (not shown) for the heating plates 17, 18. In this regard, the means of heating for the heating plates 17, 18 each have a heating device (not shown) consisting of a thermal resistor with a positive temperature coefficient, or PTC, and a device (not shown) for measuring the temperature of the heating device consisting of a thermal resistor with a negative temperature coefficient, or NTC. These heating and measurement devices will be located in housing zones 22, 23 on each arm 3, 4 for each of the heating plates 17, 18. Since the characteristics of such means of heating the heating plates 17, 18 are known to professionals in this field, they will not be described further. Variations that are known to professionals in this field or innovative are equally possible for these means of heating the heating plates 17, 18 without going beyond the scope of the invention. In addition, variations in shape are possible for the surfaces 5, 6. In particular, curved surfaces can be implemented, such as those found on hairstyling apparatuses used to curl hair, or even wavy surfaces, such as those found on hairstyling apparatuses used to crimp hair. In addition, embodiments of the handheld treatment unit 2 are possible with only one of the two surfaces 5 or 6 emitting heat, and the other surface merely contributing to clamping the lock of hair in order to style it.

Figure 2:
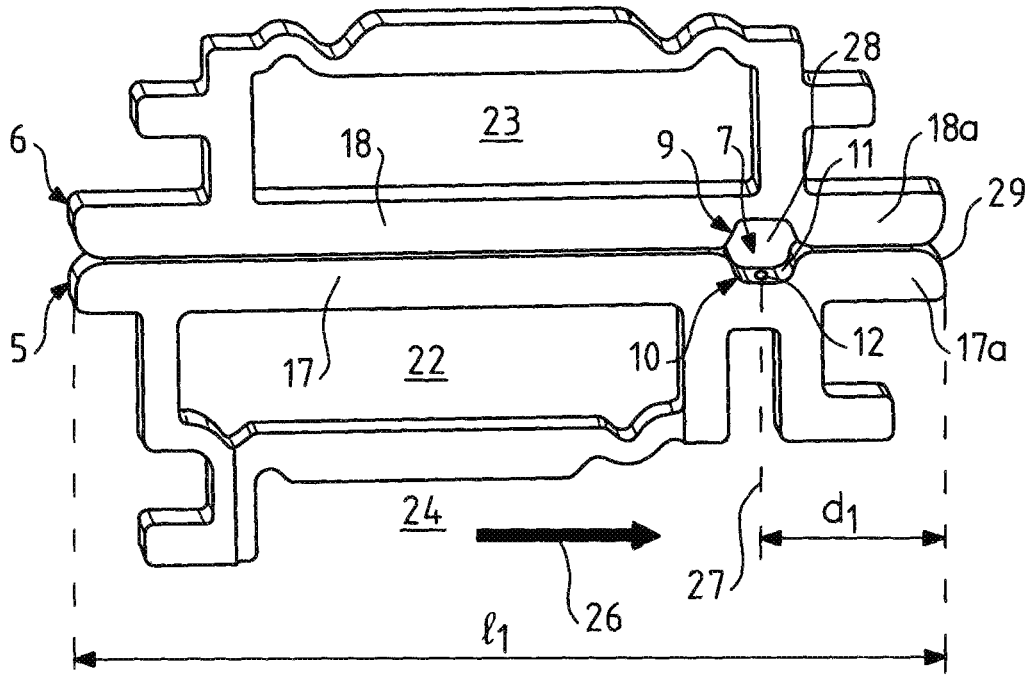
FIGS. 2 and 3 illustrate two heating plates located on the two arms of the handheld treatment unit, respectively in the clamped and open positions of the clamp.
Figure 2:
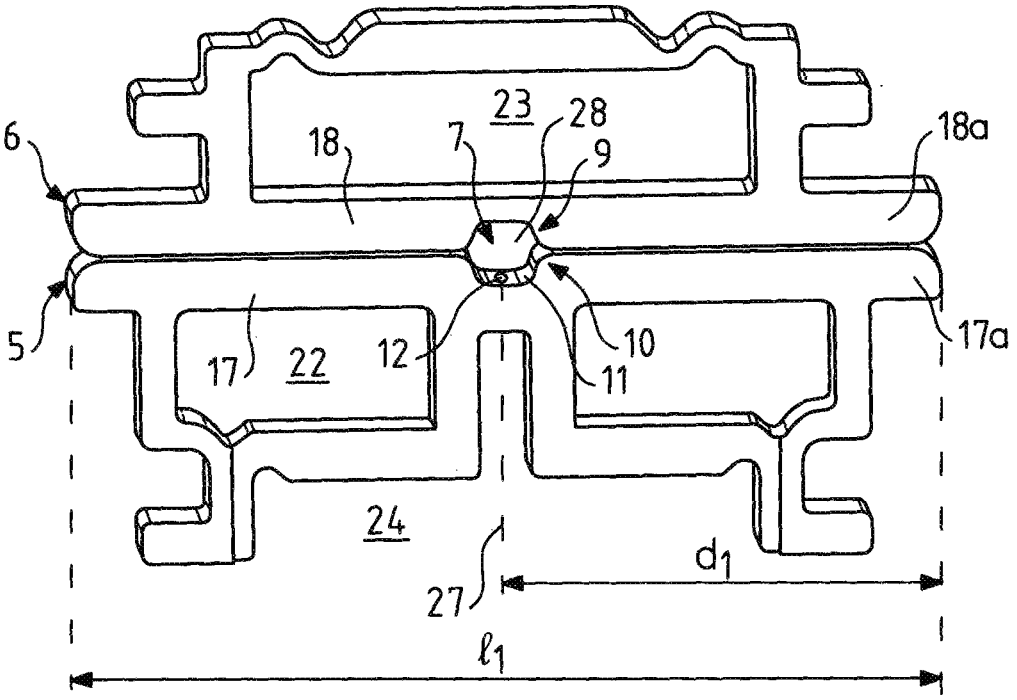
Figure 3:
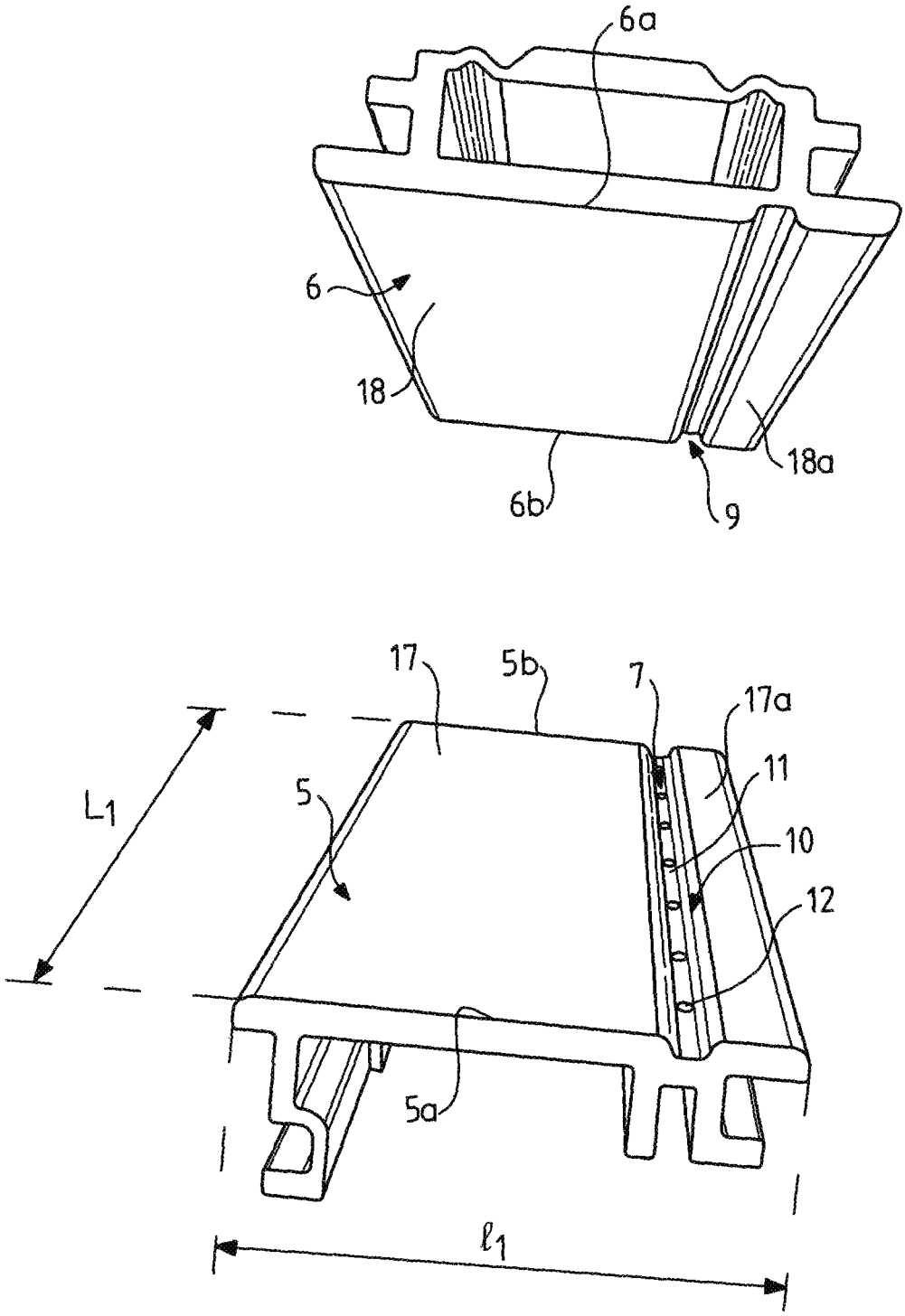

The handheld treatment unit 2 of the hairstyling apparatus 1 also comprises means of projecting or diffusing steam 7 from the first surface 5 toward the second surface 6. As shown in FIGS. 1-3, the first arm 3 has a furrow 10 with a bottom surface 11 in which orifices 12 are located that allow the projection or diffusion of steam toward the second arm 4 when the clamp is closed. The first arm 3 also has, at its distal part 3*b*, a steam generation chamber (201) that allows steam to be generated and projected or diffused through the orifices 12. In one embodiment, the handheld treatment unit 2 of the hairstyling apparatus 1 according to the invention will be able to duplicate technical characteristics comparable to those described in patent application FR 2 967 017 A1 filed by the applicant, regarding implementation of the steam generation chamber. Accordingly, this steam generation chamber comprises in particular a heating device (not shown) consisting of a thermal resistor with a positive temperature coefficient, or PTC, and a device (not shown) for measuring the temperature of the heating device consisting of a thermal resistor with a negative temperature coefficient, or NTC. These heating and measurement devices are located in a second housing zone 24 shown in FIG. 2, under the first housing zone 22. Variations that are known to professionals in this field or innovative are equally possible for this steam generation chamber, without going beyond the scope of the invention. Preferably, eight orifices 12 with a diameter of 1.2 mm are located in the bottom surface 11 of the furrow 10. In addition, the means of steam projection or diffusion are configured so as to project or diffuse steam at a flow rate of 0.5-2 g/min., preferably 0.9-1.2 g/min. Professionals in the field are able to configure such means of steam projection or diffusion so as to obtain such a flow rate. However, a flow rate of 0.5-5 g/min., essentially equal to 4 g/min., for example, is possible for a hairstyling apparatus that is smaller than that described in document FR2967017A1 and capable of producing the same flow rate.

Other characteristics, also known to professionals in the field, are also implemented on the hairstyling apparatus 1 according to the invention. The handheld treatment unit 2 comprises, in particular, a circuit board (not shown) that is configured to manage the activation of the two heating plates 17, 18 and the steam generation chamber. This circuit board is located inside one of the two arms 3, 4, in the proximal part 3*a* of the first arm 3, for example. The handheld treatment unit 2 comprises a magnetic sensor 25, shown in FIG. 1, of the reed switch (RS) type, which is able to detect the closed position of the clamp when the two surfaces 5, 6 close against each other and clamp a lock of hair. In one variation, the reed switch could be replaced by a magneto-resistive sensor, or MRS.

As illustrated in FIGS. 1-3, the furrow 10 is located in the downstream part 17*a* of the first heating plate 17 (or first surface 5 which is not necessarily a heating surface), relative to the movement direction of the handheld treatment unit 2 from the root to the end of the hair, as indicated by the arrow 26 in FIG. 2. This makes it possible to steam-treat the lock of hair before it is heat-treated (respectively, or not necessarily heated when clamped). The two ends of the furrow 10 preferably open onto the longitudinal edges 5*a*, 5*b* of the first surface 5. However, a variation is also possible in which the furrow 10 opens only onto one of the longitudinal edges 5*a*, 5*b*. As shown in FIG. 2, the median line 27 of the furrow 10 is located at a distance d1 from the downstream lateral edge 29 of the first heating plate 17. The ratio of this distance d1 to the width l1 of this heating plate 17 is preferably 0.1-0.4. For example, the width of the plate is equal to 28.9 mm and the distance d1 is equal to 6.25 mm, corresponding to a ratio of 0.22.

As shown in FIGS. 1-3, a groove 9 is located in the downstream part 18*a* of the second heating plate 18, facing the furrow 10. According to this embodiment, the groove 9 and the furrow 10 are of essentially identical shape and volume. The groove or the groove and furrow assembly forms a means of confining the diffused steam. As with the furrow 10, both ends of the groove 9 open onto the longitudinal edges 6*a*, 6*b* of the second surface 6. The groove 9 and the furrow 10 are dimensioned so as to concomitantly constitute a confinement space 28 for the steam flowing out of the orifices 12. This confinement space 28 makes it possible to contain the steam around the lock of hair clamped between the two surfaces 5, 6, before allowing that steam to escape through the ends of the groove 9 and the furrow 10, due to the replacement steam flowing from the orifices 12. Confining the steam enhances the steam treatment of the lock of hair while using a lower rate of steam flow, preferably 0.9-1.2 g/min., while ensuring fairly rapid movement of the handheld treatment unit 2 along the lock of hair. In addition, having the confinement space 28 between the two heating plates 17, 18 allows for advantageous reheating of the steam confined in that space. In order to have this confinement space 28, in a first embodiment the furrow 10 should be 2-6 mm wide, preferably 2.5 mm, and the furrow 10 should be 0.5-2 mm deep, preferably 1 mm. In addition, the volume of the furrow 10 should preferably be 200-275 $mm^3$, preferably 225 $mm^3$. The furrow 10 should preferably be 20-220 mm long, preferably 90 mm. The dimensions and volume of the groove 9 should preferably be similar, which allows the confinement space 28 to have a volume of 400-550 $mm^3$, preferably 450 $mm^3$. In a second embodiment, where the steam flow rate can be higher than in the first embodiment, for example, the furrow 10 forms a concave space in the treatment surface with a volume of 500-2500 $mm^3$; the furrow is 3-8 mm wide, preferably 4-7 mm, and is 1-4 mm deep, preferably 1.5-3 mm; the furrow is 20-220 mm long, preferably 90 mm.

FIG. 2' illustrates one way to locate the steam confinement means that is an alternative to that shown in FIG. 2. The steam confinement means illustrated in FIG. 2' include the furrow 10 and the groove 9, facing each other, but can also be only the furrow 10 or only the groove 9. The confinement means are located in the center of the treatment surface(s), all other things being equal.

Figure 4:
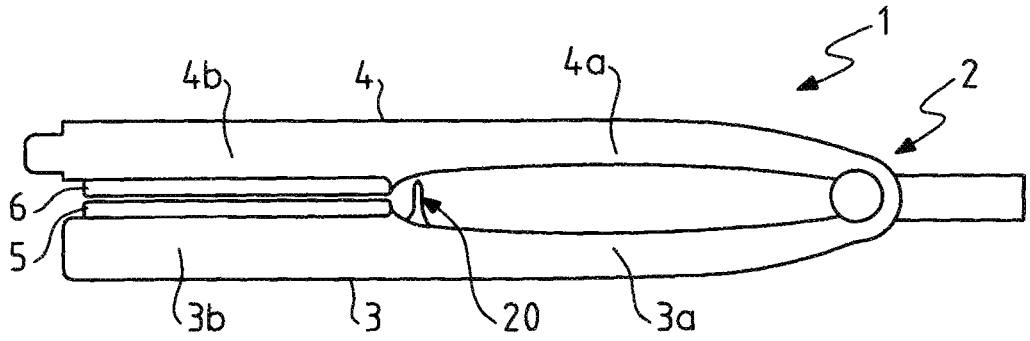
FIG. 4 illustrates an invented hairstyling apparatus, showing the presence of a steam shut-off.

As shown in FIG. 4, the handheld treatment unit 2 comprises a steam shut-off 20 located on the first arm 3, on the proximal longitudinal edge 5*a* of the first surface 5. This steam shut-off 20 prevents the steam that is escaping from the confinement space 28 from entering the area where the handheld treatment unit 2 is gripped, consisting of the proximal parts 3*a*, 4*a* of the two arms 3, 4.

Figure 5:
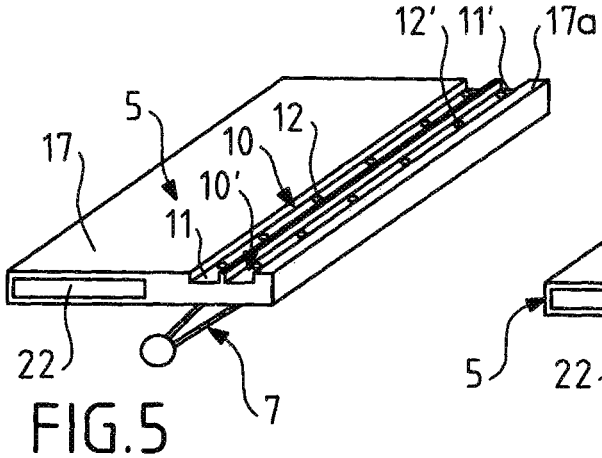
FIG. 5 illustrates a heating plate with two adjoining furrows having means of steam diffusion.

FIG. 5 illustrates one variation of the means for projecting or diffusing steam 7 onto the first surface 5. These means of projecting or diffusing steam 7 include two adjoining furrows 10, 10' with a design similar to that illustrated in FIGS. 1-3, located on the downstream part 17*a* of the first heating plate 17. Each furrow 10, 10' includes orifices 12, 12' located on the bottom surface 11, 11' of said furrow 10, 10', through which steam is projected, diffused, and transported. According to this implementation example, the groove 9 located on the second heating plate 18 has a width that matches the total width of the two furrows 10, 10'. The steam flow rate is also 0.5-2 g/min., preferably 0.9-1.2 g/min. The volume of the confinement space in this case is constituted by the volumes of the groove 9 and the furrows 10, 10'. This volume falls within a range of values that are twice that of the volume of the confinement space 28 in the embodiment shown in FIGS. 1-3. In effect, the steam channel or groove is doubled compared to the preceding embodiments, so that the steam follows a double channel and the lock of hair is steam-treated twice. The channels can be circulating liquid to one end of the surface(s). In this configuration, where steam is circulated from parallel channels through one channel to form a U shape, one alternative is for the steam outlet orifices to be present in only one of the channels (not shown).

Figure 6:
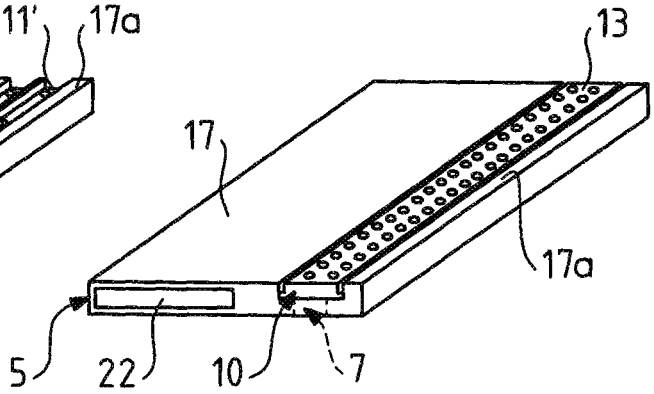
FIG. 6 illustrates a heating plate with a furrow having a perforated grid.

In FIG. 6 the means for projecting or diffusing steam 7 are similar to those in FIGS. 1-3. In addition, a grid 13 is placed over the furrow 10, which promotes even distribution of the steam being produced and moved, in the confinement space 28 comparable to that shown in FIGS. 1-3. Such a grid 13 can be placed on each furrow 10, 10' in the embodiment shown in FIG. 5.

Figure 7:
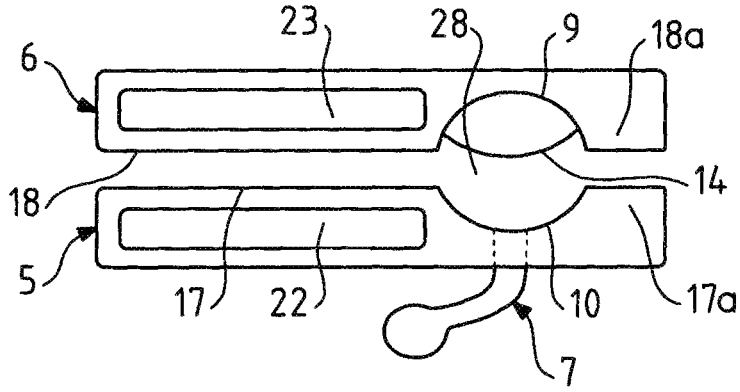
FIG. 7 illustrates two heating plates in clamped position and shows a curved shape of the furrow and a rounded perforated grid covering the groove.

In the embodiment from FIG. 7, the furrow 10 has a curved shape. The groove 9 includes a rounded grid 14 whose form complements that of said curved furrow 10. This rounded grid allows steam to be distributed evenly into the confinement space 28, and the lock of hair to be pulled as the handheld treatment unit 2 is moved. The volume of the confinement space 28 falls within a range of values similar to that of the embodiment shown in FIGS. 1-3.

Figure 8:
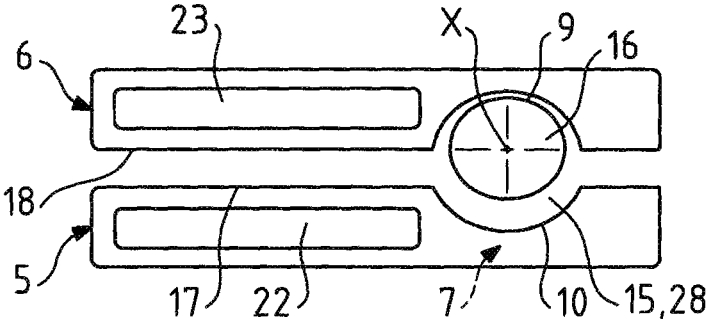
FIG. 8 illustrates two heating plates in clamped position and shows a cylindrical shape constituted by the furrow and the groove, with a perforated roller in the cylinder.

In FIG. 8, the furrow 10 and the groove 9 are circular in shape and define a cylinder 15 when the clamp is closed, with said cylinder 15 defining the confinement space 28. In addition, a perforated roller 16 is located and rotates around an axis X inside of the cylinder 15. This perforated roller 16 can be powered. The volume of the cylinder 15 falls within a range of values similar to that for the volume of the confinement space 28 from the embodiment shown in FIGS. 1-3.

Each of FIGS. 9, 10, 11, and 12 illustrates other alternatives for executing the means of confinement from FIG. 2, but they can be implemented in any of the ways described, alone or in combinations. The common point of these alternatives is one or two special piece(s) labeled 30, 30*a*, one or both of which are inserted into one or two spaces (hereinafter called gutters) provided in one or both of the heating plates. Such a piece inserted into the plate at least partially defines the contour of the means of confinement. This or these pieces make it possible to introduce additional functions to the treatment with confined steam.

Figure 9:
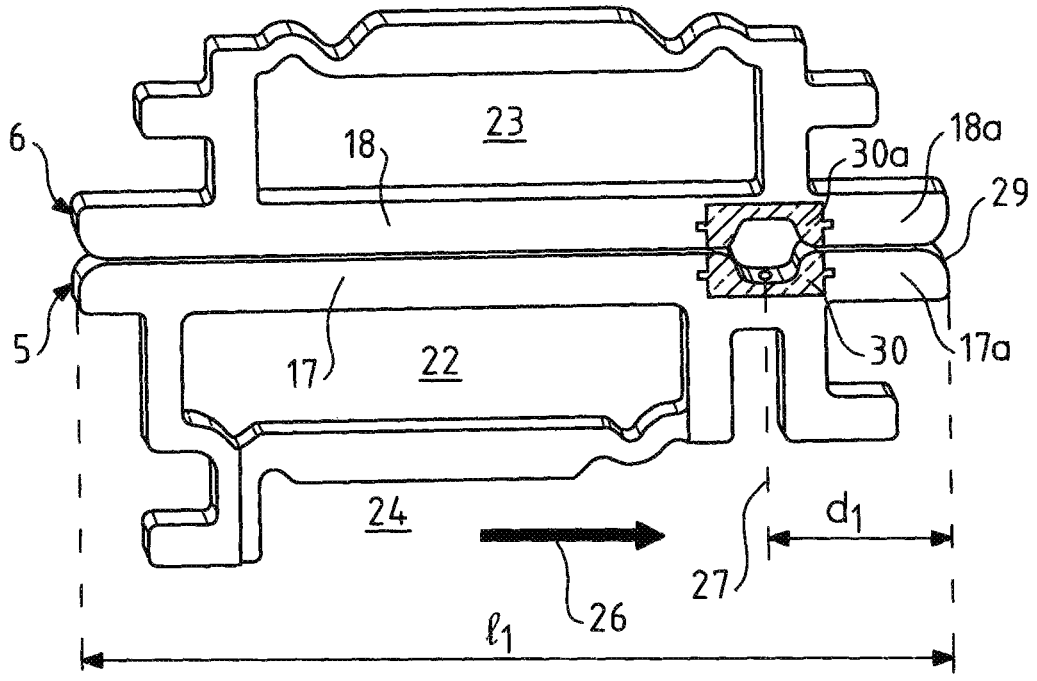
FIGS. 9, 10, 11, and 12 illustrate other alternatives for executing the means of confinement.

Accordingly, FIG. 9 illustrates one spacing configuration with one or two glass pieces inserted respectively into a provided space that is larger than the space in the groove at the end of the heating plates. One or more groove(s) are formed in one or both glass pieces. The glass piece(s) can be illuminated by one or more light-emitting diodes (LEDs) to form light bars on each side of the confinement groove.

Figure 10:
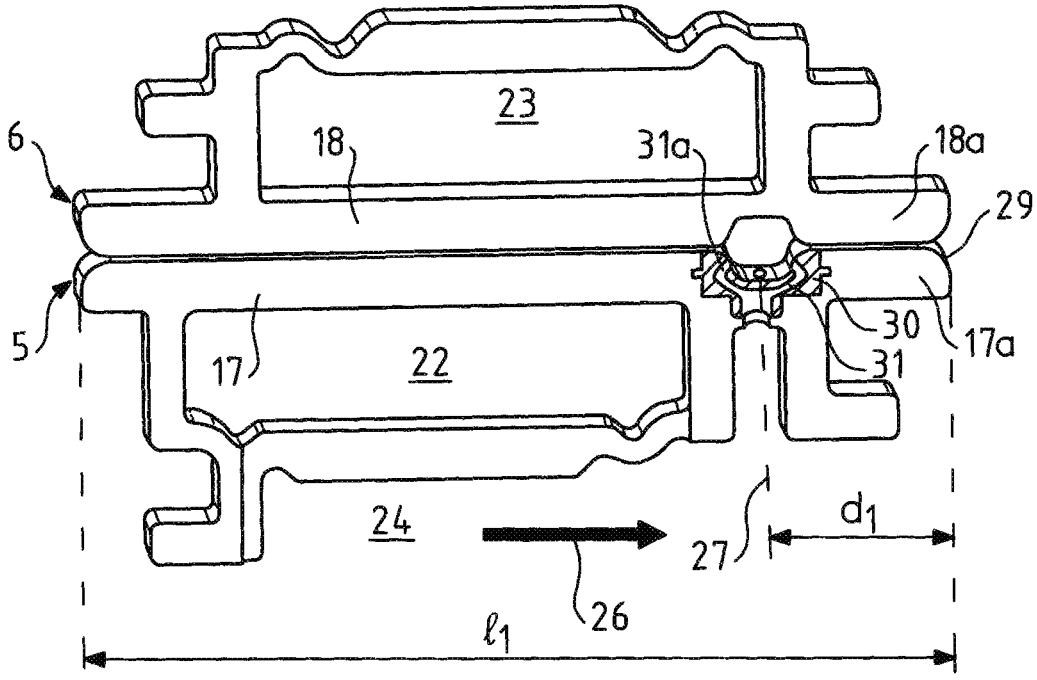

FIG. 10 illustrates an alternative in which the steam is carried by two channels 31, 31*a* that carry steam coming from the steam generation chamber. For this, the special piece is inserted into the larger space provided on the treatment surface of the plates. This piece makes it possible to redirect the steam coming through the channel from the steam generation chamber.

Figure 11:
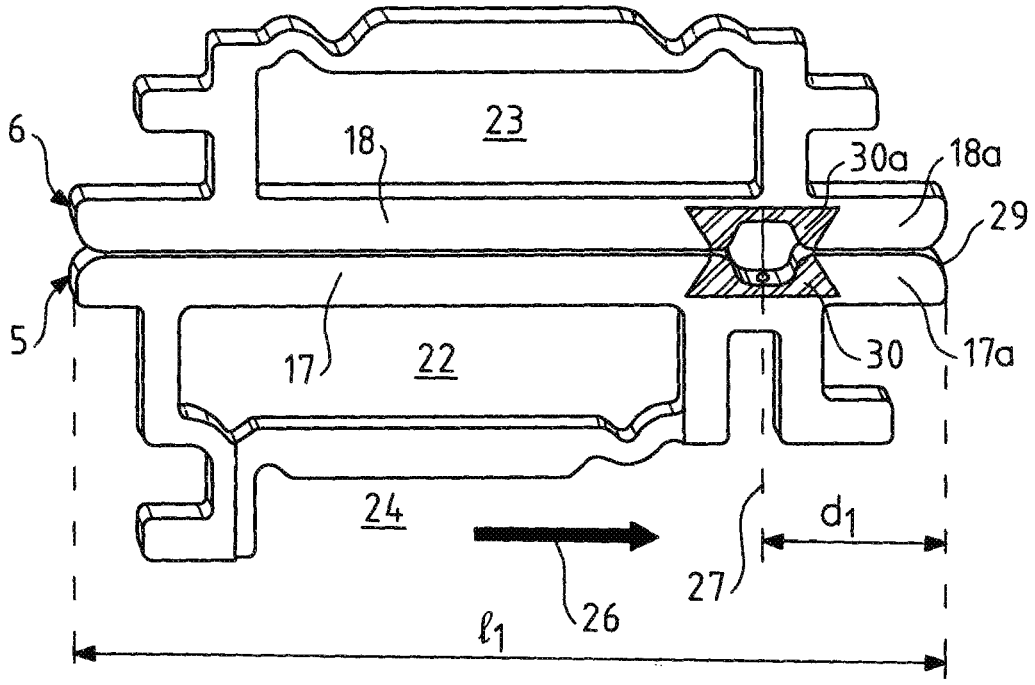

FIG. 11 illustrates an alternative in which the special piece(s) are made of aluminum, for example, and painted, and slide into the space provided, for example. They can be secured by dovetailing. It is possible to change the size of the groove(s) by replacing one or both of the special pieces.

Figure 12:
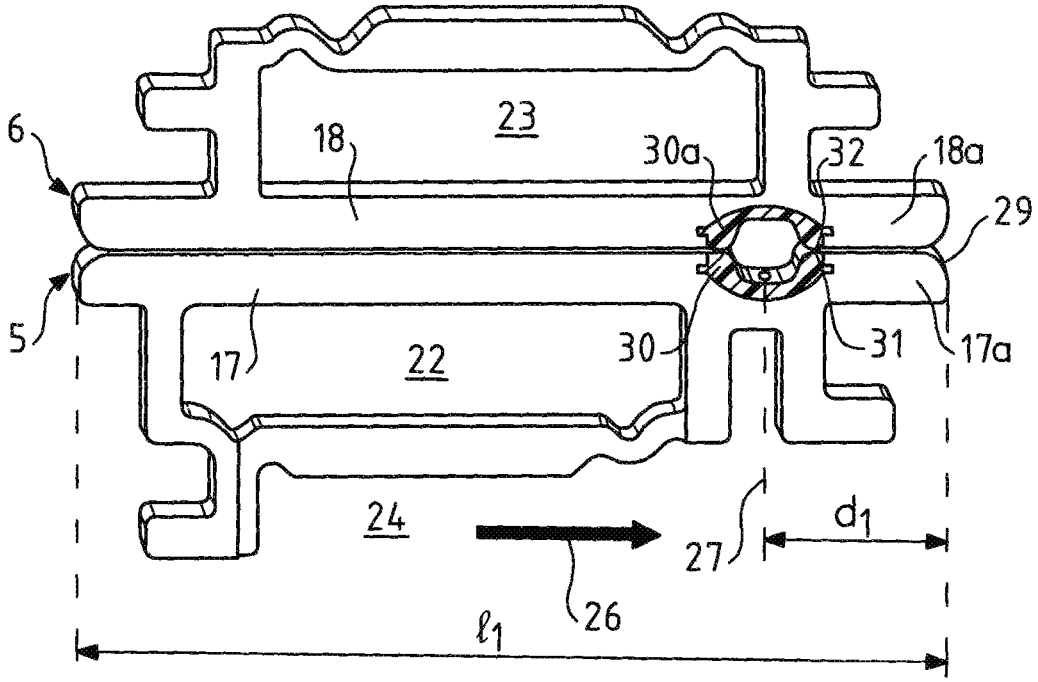

Finally, FIG. 12 illustrates an alternative in which the special piece(s) 30, 30*a* are made of silicone. Advantageously and as shown, the silicone piece 30, 30*a*, when in place, can project from the surface of the heating plate 17 and thereby create a hair tension zone 32 or traction zone 32 next to the groove, allowing for better straightening that is more gentle to the lock of hair.

In FIG. 1, a comb 19 is located downstream of the first surface 5 on the first arm 3. This comb 19 makes it possible to untangle and aerate the lock of hair before it passes between the two surfaces 5, 6.

Figure 13:
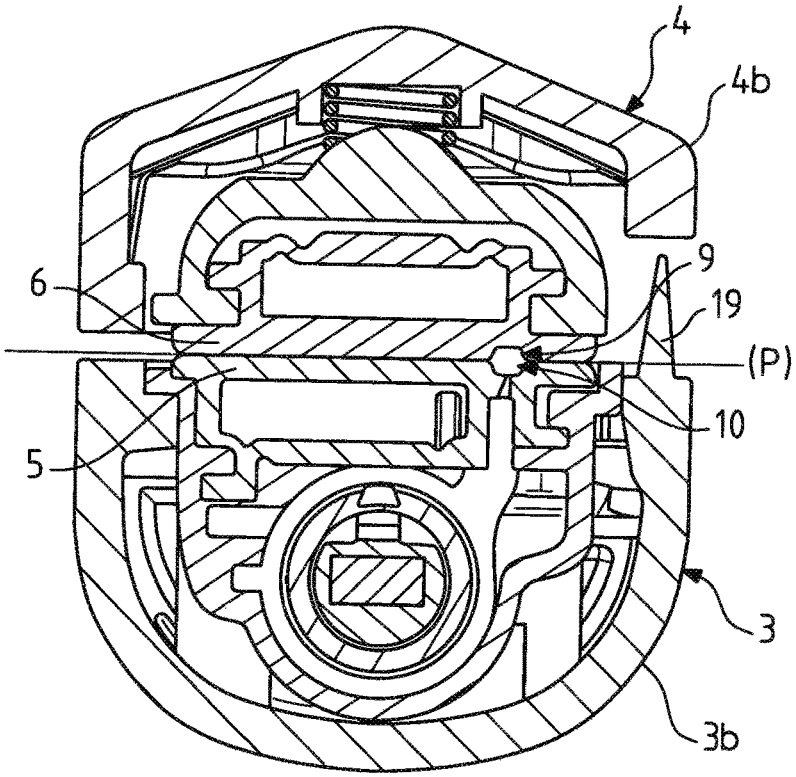
FIGS. 13, 14, and 15 illustrate a cutaway view of three possibilities for locating the comb.

In FIG. 13, a cutaway section of the apparatus as in FIG. 1, the comb 19 is shown separated from the treatment surface 5 adjacent to and facing the outer shell of the housing of the arm being shown. In closed position, the comb is not in contact with the shell. FIG. 13 illustrates a cross-section of the apparatus at the level of the treatment surfaces 5 and 6 in closed position, thus forming the means of confinement together with the furrow and the groove 9 and 10. The respective distal portions 3*b* and 4*b* of the arms 3 and 4 are shown in this cross-section.

Figure 14:
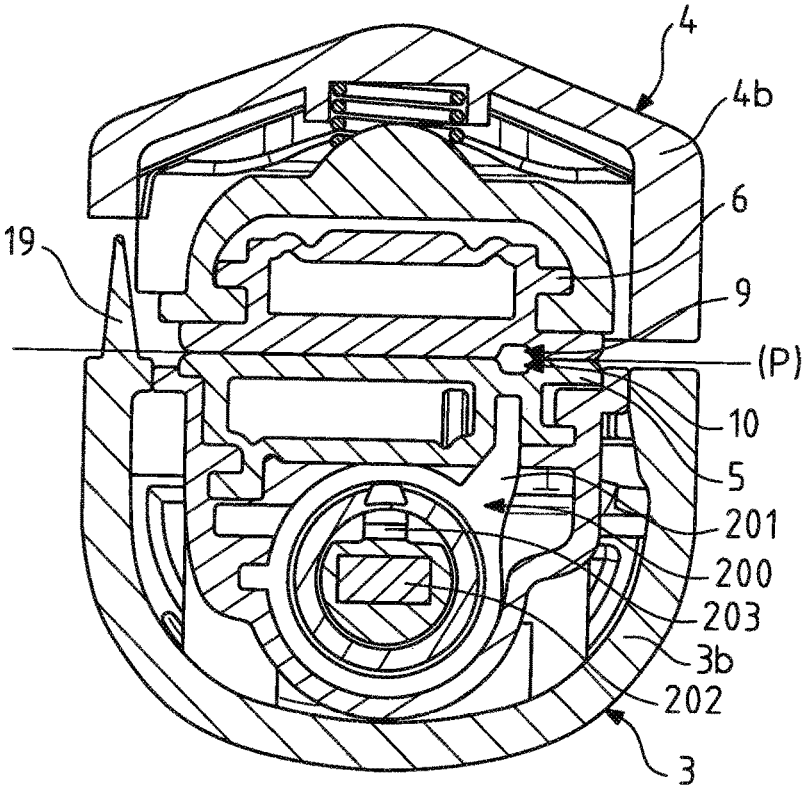

FIG. 14 is a variation of FIG. 13 with the comb located on the other side of the apparatus, and also formed in the outer shell of the arm 3.

Figure 15:
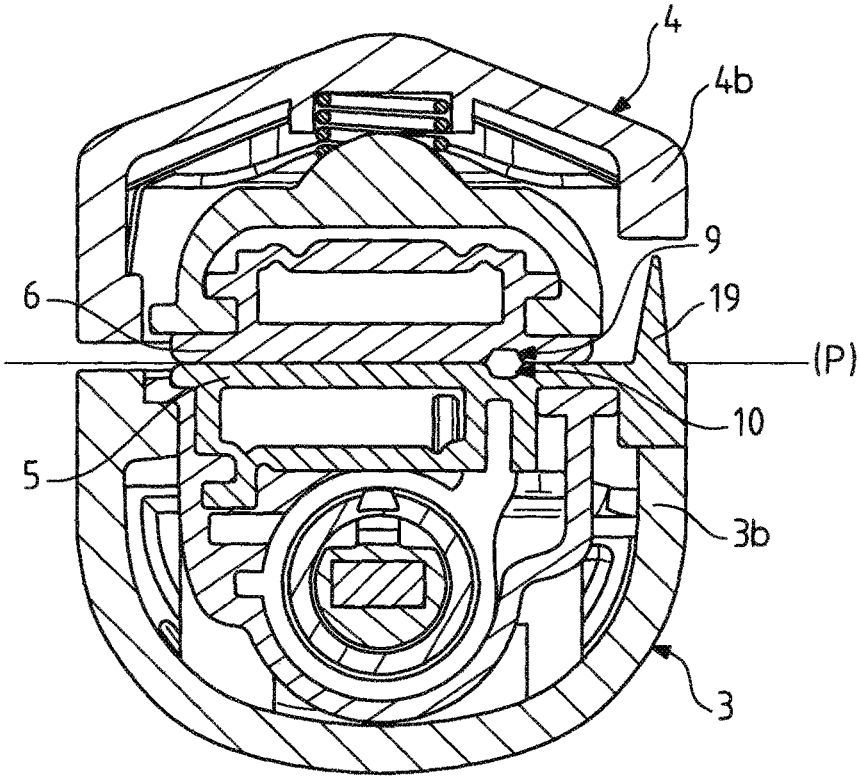

FIG. 15 is a variation of FIG. 13 with the comb forming one piece with the adjacent treatment surface 5.

As shown in FIGS. 13, 14, and 15, the means of steam generation 200 is located in the lower arm at the level of the treatment surface or straightening plate 5. The means of steam generation includes a reservoir of liquid to be converted to steam. The liquid can be water or a liquid cosmetic. This reservoir will have a fluid connection to the steam generation chamber 201. The liquid will be moved by a pump. The pump can be a water pump to provide a normal flow of steam, wherein the pump is either a mechanical water pump (valve or other type) or an electric pump; or it can be an air pump to provide a relatively low stream flow rate; or the pump can be a felt system that is moved relative to a heating element or heating device 202 to form the steam; with said movement or pump action activated when the straightener is closed. The air pump system is illustrated schematically in FIG. 18: a liquid reservoir 204 has a fluid connection through a water tube 208 to the means of steam generation 200 such that the liquid arriving in the steam generation chamber 201 is evaporated before going out toward the hair through the orifices; an air pump 205 is installed on the reservoir and has two valves (not shown). The felt system or other capillarity system used to carry the liquid is shown schematically in FIG. 19: the liquid reservoir 204 partially receives a piece of felt 206 (or a porous wicking material) against which there is at least one vent opening 209. The liquid is carried out of the reservoir through the felt by capillarity. The felt 206 and the heating device 207 can be moved with respect to each other. When the clamp is closed (for example, but not necessarily), the part of the felt 206 that is outside of the reservoir and the heating device 207 are brought into contact at the level of the steam generation chamber 201, and the liquid in the felt is evaporated and then leaves the apparatus.

Figure 20:
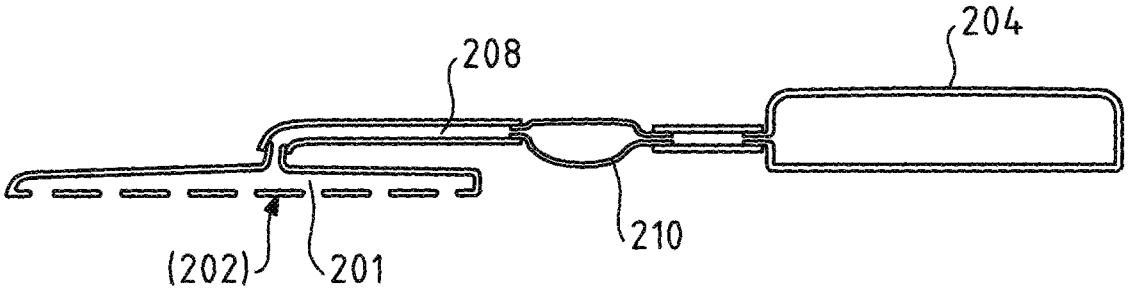
FIG. 20 illustrates one way to generate steam, using a mechanical water pump as the transport means.
Figure 21:
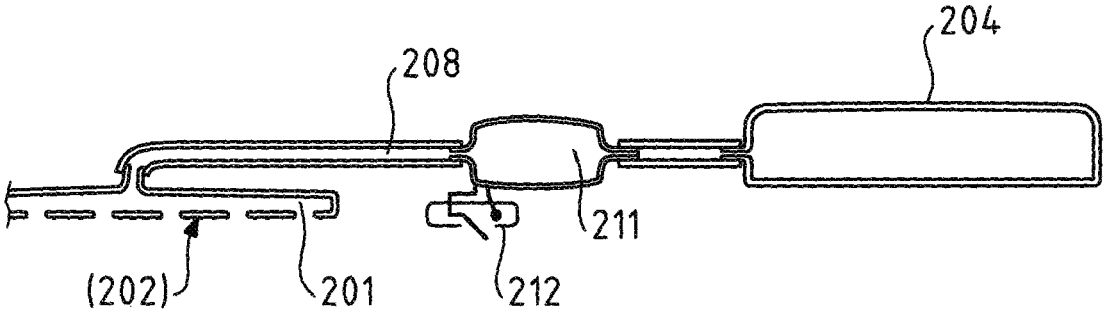
FIG. 21 illustrates one way to generate steam, using an electric pump as the transport means.

The water pump system is illustrated in patent FR2967017A1 filed by the applicant. It is also shown schematically in FIGS. 20 and 21, in the same manner as in FIGS. 18 and 19. FIG. 20 shows schematically a mechanical valve water pump system 210 located on the tube 208 connecting the liquid reservoir 204 to the steam generation chamber 201. This pump can be activated manually or automatically when the apparatus is closed, i.e., when the two surfaces 5, 6 are clamped together. FIG. 21 shows schematically an electric water pump system 211 located and operating on the tube 208 connecting the liquid reservoir 204 to the steam generation chamber 201. This pump can be activated manually or automatically when the apparatus is closed, for example. For example, a switch 212 is closed each time the user closes the jaws of the straightener and thereby activates the electric pump, which is a peristaltic pump, for example, to carry the liquid from the reservoir 204 to the steam generation chamber 201.

As shown in FIGS. 13-15, the upper arm of the straightener has a heating surface 6 that will be spring-mounted so as to allow optimal clamping of the lock of hair when the apparatus is closed and the two treatment surfaces are clamped against each other. A temperature measurement device 203 is provided to report the temperature of the means of steam generation.

Figure 16:
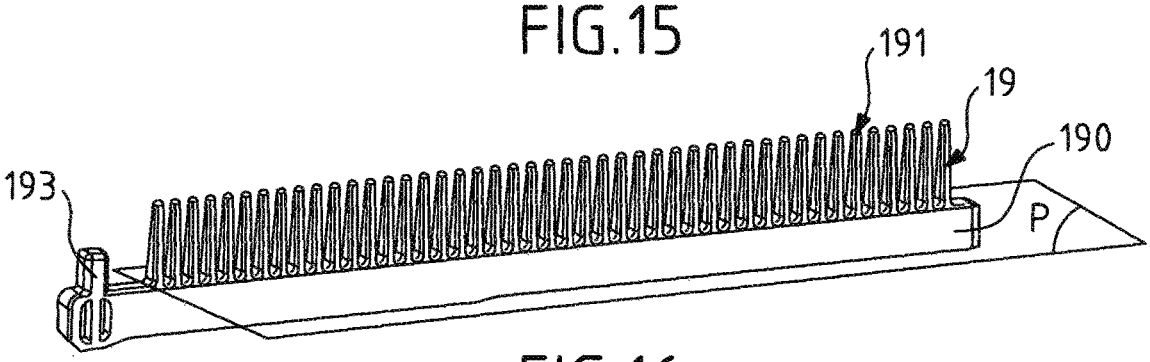
FIGS. 16 and 17 are a frontal view and a perspective view illustrating a comb according to the invention.
Figure 17:
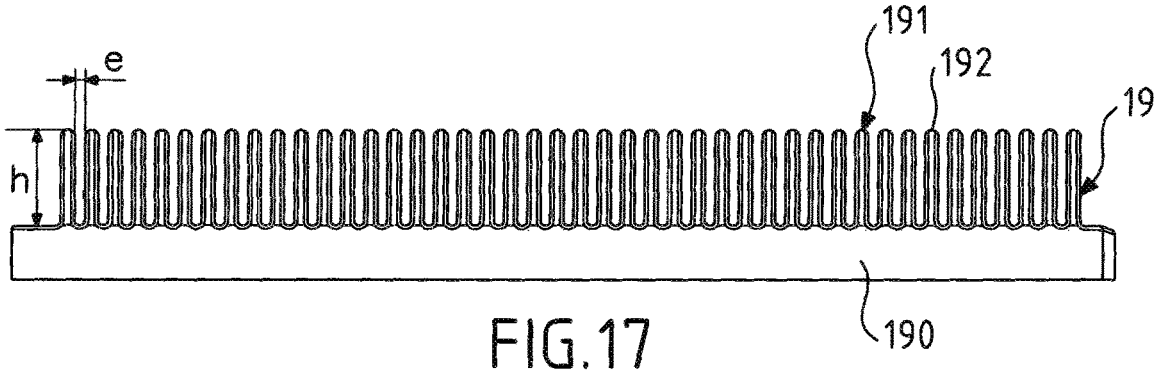
Figure 18:
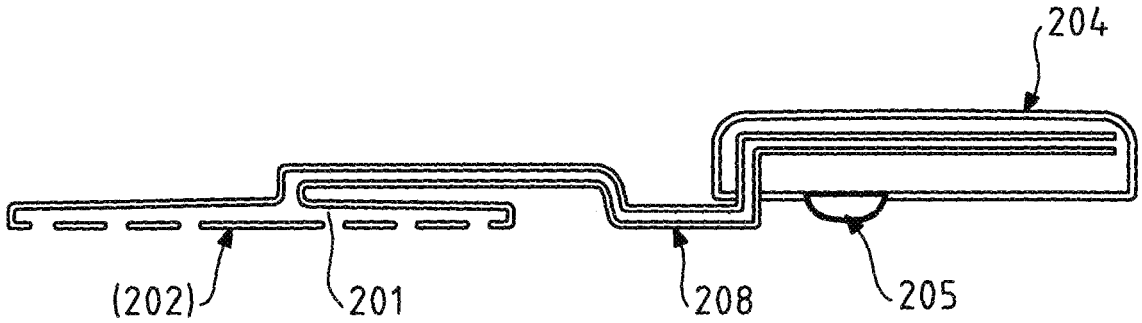
FIG. 18 illustrates one way to generate steam, using an air pump to transport the water.
Figure 19:
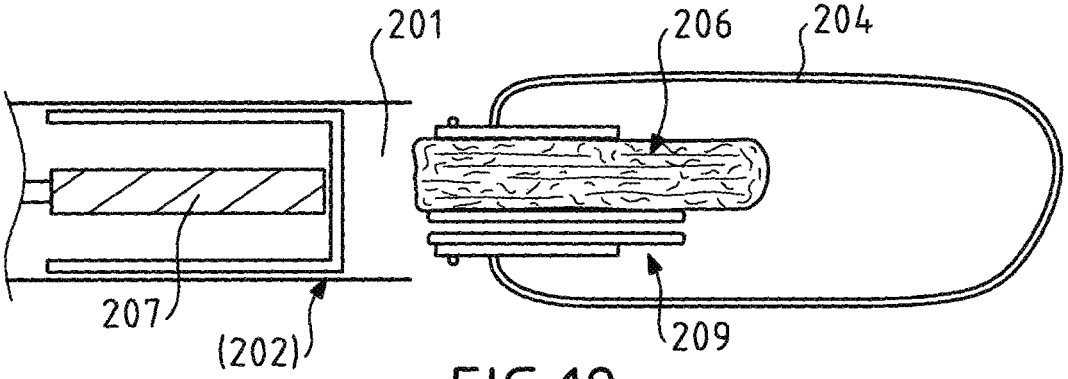
FIG. 19 illustrates one way to generate steam, using a piece of felt to transport the water.

The comb according to the invention is illustrated in FIGS. 16 and 17, in its detachable embodiment. The comb 19 includes a base 190 from which the teeth 191 extend and whose free ends 192 are the same height h and have the same spacing e between them. A tab 193 allows the comb to be pulled out of the apparatus, in particular out of a groove in the outer shell of the apparatus. The base of the teeth is in the plane P. The comb 19 is made of at least one of the following materials: thermosetting plastic, metal or aluminum alloy, thermoplastic.

Other implementation variations are possible within the scope of the invention. In particular, a confinement space can be provided that is constituted only by the volume of a groove 9 in the second surface 6, or only by the volume of a furrow 10 comprising orifices 12 for diffusing or projecting steam, on the first surface 5. In this case, said volume of the groove 9 or the furrow 10 should be dimensioned so as to constitute said steam confinement.

The means of confinement and the means of diffusing or projecting the steam 7 can also be placed on the surfaces 5, 6, separate from the heating plates 17, 18, with said means of confinement and means of diffusing or projecting the steam 7 located downstream of said heating plates 17, 18.

According to the various aforementioned embodiments, it is also possible to replace the orifices 12 for diffusing or projecting steam through a steam diffusion or projection slot located in the bottom surface 11, 11' of the furrow 10, 10', maintaining a steam flow rate of 0.5-2 g/min., preferably 0.9-1.2 g/min.

According to the various aforementioned embodiments, it is possible to add an onboard ionizer, used to deliver ions into the means of steam confinement in order to eliminate static electricity.

The invention claimed is:

1. Hairstyling apparatus comprising:

a handheld treatment unit powered electrically by an electrical cord and having two arms configured to form a clamp with two treatment surfaces that are flat and form two heating plates and which face each other and come into contact with each other when the clamp is closed, allowing a lock of hair to be clamped, wherein the handheld treatment unit comprises means of diffusing steam configured to diffuse steam from a first of the two treatment surfaces to the second of the two surfaces, and wherein one of the arms has a comb located upstream or downstream of one of the treatment surfaces of said arm, a means of diffused steam confinement between the two treatment surfaces clamped against each other, the means of diffused steam confinement comprising a single confinement space defined by: (i) a groove located in a second of the two treatment surfaces; and (ii) a furrow located in the first of the two treatment surfaces and which faces the groove, wherein the furrow comprises the means of diffusing steam such that steam is diffused from a bottom surface of the furrow toward the groove when the clamp is closed, and a steam blocking component positioned on only one arm of the handheld treatment unit, the steam blocking component projecting out from only the first arm that comprises the means of diffusing steam and which is configured to block steam escaping from the means of diffused steam confinement in a direction of a proximal part of the clamp which is configured for manipulating the handheld treatment unit, and a means of steam generation comprising a steam generation chamber with a heating device, a temperature measurement device, and a reservoir of liquid, wherein the means of steam generation is located in the first arm below the treatment surface, wherein the furrow and the groove form a cylindrical space when the clamp is in a closed position and a perforated roller is mounted to rotate inside of the cylindrical space.

2. Hairstyling apparatus as in claim 1, in which the comb is a single comb on the apparatus and is located either upstream or downstream of one of the treatment surfaces.

3. Hairstyling apparatus as in claim 1, in which the comb is spaced at a distance from an adjacent treatment surface such that the comb is not in contact with said treatment surface.

4. Hairstyling apparatus as in claim 3, in which the comb is spaced at least 1 mm away from the adjacent treatment surface.

5. Hairstyling apparatus as in claim 1, in which the comb is fastened to the adjacent treatment surface in such a way that it is in contact with said treatment surface.

6. Hairstyling apparatus as in claim 1, in which the comb defines a series of teeth extending from a base and wherein the base is located in a plane of the treatment surface.

7. Hairstyling apparatus as in claim 1, in which each of the arms has a distal portion, and in which the comb is mounted directly on the distal portion of the arm holding the comb.

8. Hairstyling apparatus as in claim 7, in which the comb is located so that it extends from a lengthwise portion of the distal portion.

9. Hairstyling apparatus as in claim 7, in which at least a free end of the teeth of the comb is brought to face a length of the distal portion of the arm that is not holding the comb when the apparatus is in closed position.

10. Hairstyling apparatus as in claim 1, in which the comb is made of at least one of the following materials: thermosetting plastic, metal or aluminum alloy, or thermoplastic.

11. Hairstyling apparatus as in claim 1, in which the comb has teeth with a pyramidal, conical, or cylindrical shape or a triangular section, or a combination of at least two of these shapes.

12. Hairstyling apparatus as in claim 1, in which the comb has teeth with a regular gap of 1-8 mm between them.

13. Hairstyling apparatus as in claim 1, in which the comb has teeth having a height of 3-25 mm.

14. Hairstyling apparatus as in claim 1, in which the comb is attached permanently to the apparatus.

15. Hairstyling apparatus as in claim 1, in which the comb is attached to the apparatus such that it can be detached.

16. Hairstyling apparatus as in claim 1, in which the means of diffusing steam is configured so as to deliver a steam flow rate of 0.5-2 g/min.

17. Hairstyling apparatus as in claim 1, in which the means of diffusing steam is configured so as to deliver a steam flow rate of 0.05-0.5 g/min.

18. Hairstyling apparatus as in claim 1, in which the means of steam generation includes the reservoir for liquid to be converted to steam and, in the fluid connection to the steam generation chamber, a water pump designed to activate when the two surfaces are clamped together, to move the liquid from the reservoir to the steam generation chamber.

19. Hairstyling apparatus as in claim 1, in which the means of steam generation includes the reservoir for liquid to be converted to steam and, in the fluid connection to the steam generation chamber, an air pump designed to activate when the two surfaces are clamped together, to move the liquid from the reservoir to the steam generation chamber.

20. Hairstyling apparatus as in claim 1, in which the means of steam generation includes the liquid reservoir with a fluid connection to a piece of felt intended to come into contact with the heating device.

21. Hairstyling apparatus as in claim 1, in which the treatment surfaces have a length (L1) of 80-120 mm and a width (l1) of 20-35 mm.

* * * * *